US010520845B2

(12) United States Patent
Kuroda

(10) Patent No.: US 10,520,845 B2
(45) Date of Patent: Dec. 31, 2019

(54) CHARGING MEMBER FOR ELECTROPHOTOGRAPHIC IMAGING APPARATUS

(71) Applicant: HEWLETT-PACKARD DEVELOPMENT COMPANY, L.P., Spring, TX (US)

(72) Inventor: Noriaki Kuroda, Shizuoka (JP)

(73) Assignee: HP PRINTING KOREA CO., LTD., Suwon-si (KR)

( * ) Notice: Subject to any disclaimer, the term of this patent is extended or adjusted under 35 U.S.C. 154(b) by 0 days.

(21) Appl. No.: 15/990,263

(22) Filed: May 25, 2018

(65) Prior Publication Data

US 2018/0275551 A1 Sep. 27, 2018

Related U.S. Application Data

(63) Continuation of application No. PCT/KR2016/013677, filed on Nov. 25, 2016.

(30) Foreign Application Priority Data

Nov. 27, 2015 (JP) ..... 2015-231764

(51) Int. Cl.
*G03G 15/02* (2006.01)

(52) U.S. Cl.
CPC ..... *G03G 15/0233* (2013.01)

(58) Field of Classification Search
None
See application file for complete search history.

(56) References Cited

U.S. PATENT DOCUMENTS 5,819,142 A * 10/1998 Murata ..... G03G 15/0233 399/176
2001/0018155 A1 8/2001 Tashiro et al.
2006/0029428 A1* 2/2006 Taniguchi ..... G03G 15/0233 399/176

(Continued)

FOREIGN PATENT DOCUMENTS

JP 2004294849 10/2004
JP 2006189595 7/2006

(Continued)

OTHER PUBLICATIONS

"Handbook of Chemistry; Pure Chemistry", Japan, Maruzen K.K., Sep. 30, 1993, 4th Edition, No. I pp. 560-563.

*Primary Examiner* — David M. Gray
*Assistant Examiner* — Geoffrey T Evans
(74) *Attorney, Agent, or Firm* — Staas & Halsey LLP

(57) ABSTRACT

Provided are a charging member coupleable to an electrophotographic imaging apparatus. The charging member includes an electrically-conductive support body, an electrically-conductive elastomer layer stacked on a surface of the electrically-conductive support body, and an electrically-conductive resin layer stacked as an outermost layer on the electrically-conductive elastomer layer. The electrically-conductive resin layer includes a binder resin and particles comprising at least one type of particles selected from resin particles and inorganic particles, wherein a relative dielectric constant (εr1) of the binder resin is greater than or about equal to a relative dielectric constant (εr2) of at least one type of particles.

15 Claims, 2 Drawing Sheets

(56) References Cited

U.S. PATENT DOCUMENTS

| | | | | |
|---|---|---|---|---|
| 2008/0175625 | A1 | 7/2008 | Goto et al. | |
| 2009/0067874 | A1* | 3/2009 | Hoshio | G03G 15/0225 399/100 |
| 2011/0177448 | A1 | 7/2011 | Ueno et al. | |
| 2012/0093539 | A1* | 4/2012 | Nagamine | G03G 15/0233 399/111 |
| 2013/0170860 | A1 | 7/2013 | Martinkovic et al. | |
| 2015/0185657 | A1 | 7/2015 | Matsui et al. | |
| 2015/0277252 | A1 | 10/2015 | Takahashi et al. | |
| 2015/0301469 | A1* | 10/2015 | Aoyama | G03G 15/0208 399/176 |
| 2017/0115590 | A1* | 4/2017 | Furukawa | G03G 15/0233 |
| 2019/0271931 | A1* | 9/2019 | Kuroda | B32B 25/14 |

FOREIGN PATENT DOCUMENTS

| | | |
|---|---|---|
| JP | 2007065469 | 3/2007 |
| JP | 2008180775 | 8/2008 |
| JP | 2009009044 | 1/2009 |
| JP | 2010231007 | 10/2010 |
| JP | 2012014048 | 1/2012 |
| WO | WO-2013118576 | 8/2013 |

* cited by examiner

CHARGING MEMBER FOR ELECTROPHOTOGRAPHIC IMAGING APPARATUS

CROSS-REFERENCE TO RELATED APPLICATIONS

This application is a continuation application of PCT international patent application no. PCT/KR2016/013677, filed on Nov. 25, 2016, which claims priority from Japanese patent application no. 2015-231764, filed on Nov. 27, 2015 in the Japan Patent Office, the content of each of the foregoing is incorporated herein by reference.

BACKGROUND

In order to improve charging uniformity of a charging member for an electrophotographic imaging apparatus, "an alternating current (AC) charging technique" has been used, in which a voltage of a direct current (DC) voltage component overlapped with an AC voltage component is applied to a charging member in contact.

DETAILED DESCRIPTION

Figure 1:
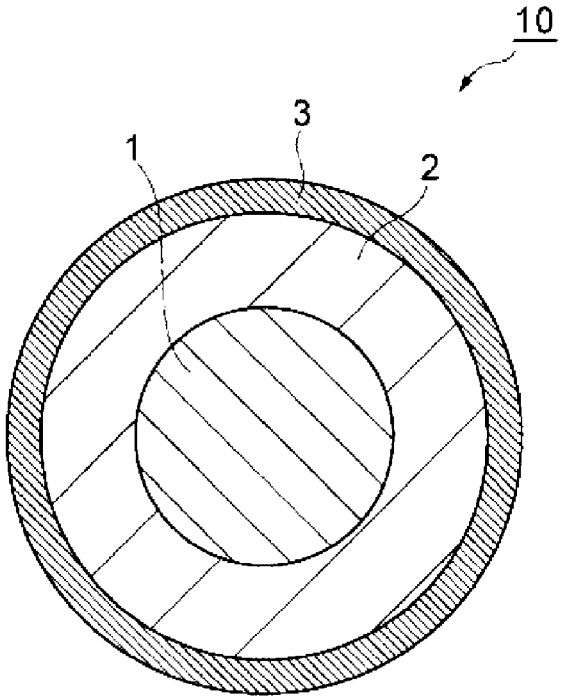
FIG. 1 is a schematic cross-sectional view of a charging member according to an example.

Since a high AC voltage having a peak-to-peak voltage that is at least double a discharge start voltage (Vth) of a DC voltage to be applied is overlapped with a DC voltage, a separate AC power supply is needed in addition to a DC power supply, resulting in an increase in the cost of an electrophotographic imaging apparatus. Furthermore, due to the occurrence of a large amount of close proximity discharging between a charging roller and a photoconductor, the durability of the charging roller and the photoconductor may deteriorate. In particular, the photoconductor may be easily abraded.

This may be reduced by charging the charging roller by applying a DC voltage alone.

In addition, there is still a demand for high-quality images to be output in recent imaging apparatuses. In order to respond to such a demand, for example, an imaging apparatus may form a surface layer having projections on a surface of a charging member, the projections being derived from resin particles.

However, when only a direct current voltage is applied to the charging member, a discharge area becomes narrow, which makes it difficult to allow a photoconductor to maintain a stable potential. In this regard, uneven charging may easily occur when a toner or an external additive thereof contaminates a surface of the charging member. Furthermore, particles may drop out from the surface of the charging member. As a result, it is difficult to design a charging member having a long lifespan.

In addition, improvement may be necessary in terms of sharpness of the obtained images and the like.

Therefore, the present disclosure, for example, provides a charging member capable of maintaining stable charging properties for a long period of time even if charging is performed by applying only a direct current voltage thereto, and achieving high quality of an output image.

The present disclosure, for example, provides an electrophotographic imaging apparatus capable of maintaining stable charging properties for a long period of time when only a direct current voltage is applied thereto, and achieving high quality of an output image.

For example, even if only a direct current voltage is applied to a charging member and an electrophotographic imaging apparatus, stable charging properties may be maintained over a long period of time, and high quality of an output image may be achieved.

Reference will now be made in detail to examples, examples of which are illustrated in the accompanying drawings, wherein like reference numerals refer to like elements throughout. In addition, the positional relationships of the upper, lower, left, and right sides are based on the positional relationships shown in the drawings, unless otherwise specified. Furthermore, the dimensional ratios in the drawings are not limited to the illustrated ratios.

<Charging Member>

A charging member according to an example includes an electrically-conductive support, an electrically-conductive elastomer layer stacked on the electrically-conductive support, and an electrically-conductive resin layer stacked as an outermost layer on the electrically-conductive elastomer layer. FIG. 1 is a schematic cross-sectional view of a charging member 10 according to an example. As shown in FIG. 1, the charging member 10 has an electrically-conductive elastomer layer 2 and an electrically-conductive resin layer 3 that are integrally stacked in this stated order, from the inside to the outside in a direction of a roll diameter, on an outer circumferential surface of an electrically-conductive support (shaft body) 1. In addition, considering that FIG. 1 is only a schematic view, a case where an interlayer, such as, for example, a resistance adjusting layer, for increasing voltage resistance (leakage resistance) is disposed between the electrically-conductive elastomer layer 2 and the electrically-conductive resin layer 3 is not excluded.

In an imaging apparatus, the charging member 10 as shown in FIG. 1 may be included as a charging means which serves to charge an object to be charged. In particular, the charging member 10 may function as a means that uniformly charges a surface of a photoconductor, which is an image carrier.

[Electrically-Conductive Support]

The electrically-conductive support is not particularly limited, so long as the electrically-conductive support includes a metal having an electrical conductivity or is formed of such a metal. For example, a metallic hollow body (a pipe type) or solid body (a rod type) formed of iron, copper, aluminum, nickel, or stainless steel may be used. The outer circumferential surface of the electrically-conductive support may be subjected to a plating process as needed, to a degree that would not degrade the conductivity, so as to impart the corrosion- or wear-resistance to the outer surface. In addition, an adhesive or a primer may be coated, as needed, on the same outer circumferential surface to increase an adhesive property with the electrically-conductive elastomer layer. Here, to secure sufficient conductivity, the adhesive or primer may be treated to have an electrical conductivity as needed.

The electrically-conductive support may be in a cylindrical form with, for example, a diameter in a range of about 5 mm to about 10 mm and a length in a range of about 250 mm to about 360 mm.

[Electrically-Conductive Elastomer Layer]

The electrically-conductive elastomer layer is not particularly limited, so long as it has appropriate elasticity for securing the intimate contact with a photoconductor. For example, the electrically-conductive elastomer layer may be formed by using, as a base polymer, at least one selected from a natural rubber; a synthetic rubber, such as an ethylene-propylene-diene rubber (EPDM), a styrene-butadiene rubber (SBR), a silicone rubber, a polyurethane-based elastomer, an epichlorohydrin rubber, an isoprene rubber (IR), a butadiene rubber (BR), an acrylonitrile-butadiene rubber (NBR), a hydrogenated NBR (H-NBR), or a chloroprene rubber (CR); and a synthetic resin, such as a polyamide resin, a polyurethane resin, or a silicone resin. The materials may be used alone or as a combination of at least two selected therefrom.

Conventional additives, such as a conducting agent, a vulcanizing agent, a vulcanizing accelerator, a lubricant, or a processing-aid, may be appropriately added to the base polymer in order to give certain properties to the electrically-conductive elastomer layer. However, in terms of forming a stable electrical-resistance, the electrically-conductive elastomer layer may include an epichlorohydrin rubber, particularly, for example, as a main ingredient. In particular, the electrically-conductive elastomer layer may include an epichlorohydrin rubber in an amount of about 50.0 wt % or more, or about 80.0 wt % or more.

In addition, examples of the conducting agent may include carbon black, graphite, potassium titanate, iron oxides, conductive titanium oxide (c-$TiO_2$), conductive zinc oxide (c-ZnO), electrically-conductive tin oxide (c-$SnO_2$), and a quaternary ammonium salt. An example of the vulcanizing agent may include sulfur. An example of the vulcanizing accelerator may include tetramethyl thiuram disulfide (CZ). An example of the lubricant may include stearic acid. An example of the processing-aid may include zinc oxide (ZnO).

A thickness of the electrically-conductive elastomer layer may be in a range of about 1.25 mm to about 3.00 mm for appropriate elasticity.

[Electrically-Conductive Resin Layer]

Figure 2:
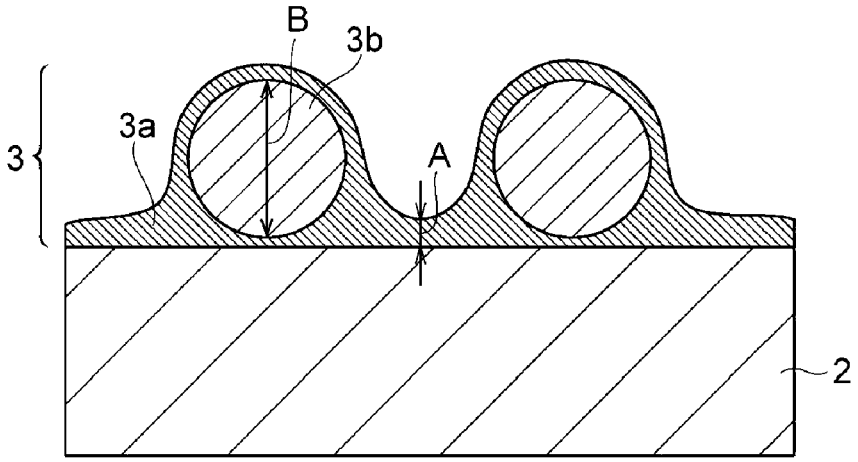
FIG. 2 is an enlarged schematic cross-sectional view of a surface of an electrically-conductive resin layer of a charging member, according to an example.

The electrically-conductive resin layer may include a binder resin and at least one type of particles selected from the group consisting of resin particles and inorganic particles. FIG. 2 is an enlarged schematic cross-sectional view of a surface of the electrically-conductive resin layer of the charging member according to an example. As shown in FIG. 2, the electrically-conductive resin layer 3 includes a binder resin (i.e., a matrix material) 3*a* and a plurality of at least one type of particles 3*b* selected from the group consisting of resin particles and inorganic particles, wherein the plurality of the particles are dispersed in the binder resin.

The binder resin is not particularly limited, so long as it does not contaminate a photoconductor, which is an object to be charged. For example, the binder resin 3*a* may include, as a base polymer, a fluorine-containing resin, a polyamide resin, an acrylic resin, a nylon resin, a polyurethane resin, a silicone resin, a butyral resin, a styrene-ethylene/butylene-olefin copolymer (SEBC), or an olefin-ethylene/butylene-olefin copolymer (CEBC). The materials above may be used alone or as a combination of at least two selected therefrom. In one example, in terms of easiness of handling or a degree of freedom for material design, the binder resin 3*a* may include at least one selected from the group consisting of a fluorine-containing resin, an acrylic resin, a nylon resin, a polyurethane resin, and a silicone resin, and more particularly, may include at least one selected from the group consisting of a nylon resin and a polyurethane resin.

Here, a thickness of the electrically-conductive resin layer, that is, a thickness of a part formed of the binder resin alone (a thickness of a part indicated by "A" in FIG. 2) may be in a range of about 0.5 μm to about 5.0 μm. In detail, a thickness of the electrically-conductive resin layer is a thickness at the midpoint between the most closely adjacent particles. When the thickness is about 0.5 μm or greater, it becomes easier for the resin particles and/or inorganic particles to be added to be continuously maintained without dropping out over a long period of time, and, when the thickness is about 5.0 μm or less, it becomes easier for the charging performance of the charging member to be maintained well. In this regard, the thickness of the electrically-conductive resin layer may be in a range of about 1.0 μm to about 4.5 μm, or, for example, about 2.0 μm to about 4.0 μm. In addition, the thickness of the electrically-conductive resin layer may be measured by observing a cross-section of a roller, which has been cut with a sharp blade, through an optical microscope or an electron microscope.

The particles are not particularly limited, so long as it may form a concave-convex surface of the electrically-conductive resin layer to sufficiently secure discharge points and may satisfy particular relative dielectric constant described below. Examples of the resin particles may include an olefin-based resin, such as polyethylene and polypropylene, and a fluorine-containing resin, such as polyvinyl fluoride, or a copolymer of vinylidene fluoride and hexafluoropropylene. Examples of the inorganic particles may include silica and alumina, etc. These particles may be used alone or as a combination of at least two selected therefrom. In one example, in terms of appropriate dielectric properties, particle strength, and the like, at least one type of the particles selected from an olefin-based resin and silica may be used. In addition, an example of the olefin-based resin particles may be an ultra-high molecular weight polyethylene particle. Here, the term "ultra-high molecular weight polyethylene particle" as used herein refers to a particle consisting of polyethylene having a weight average molecular weight of at least 1,000,000 (or 7,000,000 or less). In addition, these particles may be insulating particles.

When these particles are inorganic particles, the inorganic particles may have a porous structure. In particular, the inorganic particles may be porous silica particles, wherein the degree of the porosity of the inorganic particles may be measured by oil adsorption based on JIS K 5101-13-1. In one example, the oil adsorption of the inorganic particles may be in a range of about 30 ml/100 g to about 300 ml/100 g. When the oil adsorption is about 30 ml/100 g or more, the particle strength may be easily controlled, whereas, when the oil adsorption is about 300 ml/100 g or less, the relative dielectric constant may be easily controlled. In this regard, the oil adsorption may be in a range of about 50 ml/100 g to about 200 ml/100 g.

In one example, an average particle diameter of the particles may be in a range of about 5.0 μm to about 25.0 μm (see part indicated as "B" in FIG. 2) in terms of suppressing charging unevenness, which indicates initial image defects. In the same regard, an average particle diameter of the particles may be in a range of about 10.0 μm to about 20.0 μm. In addition, the average particle diameter of the particles may be obtained by randomly selecting 100 particles from a group of a plurality of particles from scanning electron microscope (SEM) observation and calculating an average value of the diameters of the 100 particles. However, when a particle diameter is not consistent as in the case that particles have a shape of an ellipsoid (of which a cross-sectional shape is an ellipse) or other irregular shapes, not a complete sphere, a simple average value of the longest diameter and the shortest diameter is determined as a particle diameter of the particles.

An interparticle distance on the surface of the electrically-conductive resin layer (Sm) (a distance between projections on the surface of the electrically-conductive resin layer) may be in a range of about 50 μm to about 250 μm. When the interparticle distance is about 50 μm or more, the particle drop-out from the surface of the electrically-conductive resin layer may be easily suppressed. When the interparticle distance is about 250 μm or less, the rustling dry image may be easily suppressed. In the same regard, the interparticle distance (Sm) may be in a range of about 70 μm to about 200 μm, and for example, about 100 μm to about 150 μm. In addition, the interparticle distance may be measured based on JIS B0601-1994.

In one example, when a relative dielectric constant of the binder resin is referred to as εr1, and a relative dielectric constant of a type of the particles is referred to as εr2, εr1 and εr2 satisfy the requirement of εr2<εr1. Here, in terms of easy suppression of the discharge of the concave portion of the concave-convex surface generated by the addition of the particles, the relative dielectric constant of the binder resin εr1 may be in a range of about 4.5 to about 10.0, and for example, about 4.5 to about 7.0. In terms of easy suppression of the discharge of the convex portions of the concave-convex surface generated by the addition of the particles, the relative dielectric constant of the binder resin εr1 may be in a range of about 1.5 to about 4.0, for example, about 2.0 to about 3.5. The relative dielectric constant of each of the binder and the particles may be measured by an impedance analyzer, for example, such as a dielectric impedance measuring system 126096 W produced by Toyo Technica Co., Ltd. (measurement condition: AC bias of 3 V, measurement frequency of 1 MHz).

A content of the particles may be in a range of about 10 parts to about 50 parts by weight based on 100 parts by weight of the binder resin contained in the electrically-conductive resin layer. When the content of the particles is 10 parts by weight or higher, charging performance tends to be easily satisfied, and when the content is 50 parts by weight or lower, particle sedimentation from the coating composition may be easily controlled and stability of the coating composition may not be deteriorated. In the same regard, the content may be in a range of about 15 parts to about 45 parts by weight, for example, about 20 parts to about 30 parts by weight. The particle content included in the electrically-conductive resin layer may be quantified as follows. For example, a sample of the electrically-conductive resin layer may be obtained from a charging member, and then, a weight change (measured by thermogravimetric analysis (TGA)), a differential heat (measured by dynamic thermal analysis (DTA)), a quantity of heat (measured by differential scanning calorimetry (DSC)), and the mass of volatile components (measured by mass spectroscopy (MS)), all caused by performing a heating process on the sample, may be measured, thereby quantifying the particle content (TG-DTA-MS, DSC).

A shape of the particles is not particularly limited, so long as a concave-convex surface of the electrically-conductive resin layer may be formed, and examples of the shape may include a sphere, an ellipsoid, an irregular shape, and the like.

In addition, any conducting agent (conductive carbon, graphite, copper, aluminum, nickel, iron, conductive tin oxides, conductive titanium oxides, an ion conducting agent, or the like) or an antistatic agent may be included in the binder resin (i.e., a base polymer), in addition to the particles described above.

A 10-point average roughness (RzJIS) of a surface of the electrically-conductive resin layer may be in a range of about 5.0 μm to about 25.0 μm. When the 10-point average roughness is about 5.0 μm or greater, charging performance may be easily secured, and when the 10-point average roughness is about 25.0 μm or less, stability of the coating composition tends to be easily obtained. In the same regard, the 10-point average roughness may be in a range of about 8.0 μm to about 20.0 μm, for example, about 10.0 μm to about 15.0 μm. The 10-point average roughness may be measured by using a surface roughness tester, SE-3400, available from Kosaka Laboratory Co., Ltd. In particular, the 10-point average roughness may be calculated by adding an average value of the absolute altitude values of the peak-tops from the highest peak to the $5^{th}$ highest peak; and an average value of the absolute altitude values of the valley-bottoms from the lowest valley-bottom to the $5^{th}$ lowest valley-bottom, where the peak-top altitudes and the valley-bottom altitudes are obtained from the reference length sampled from a roughness curve obtained by using the tester.

In one example, only a direct current voltage may be applied to the charging member, and more particularly, a bias voltage applied thereto may be in a range of about −1,500 V to about −1,000 V, during an image printing process, until the end of the lifespan of the photoconductor. Accordingly, the charging performance may be maintained under various environments, and image concentration or other various conditions may be easily controlled. In particular, when the bias voltage is higher than about −1,000 V, development conditions needed for image formation may not be optimized. In particular, when the bias voltage is lower than about −1,500 V, over-discharge may occur at the particles of the electrically-conductive resin layer, and thus image defects in the form of white spots after forming the image may easily occur.

<Preparation Method of Charging Member>

For example, a charging member 10 according to an example shown in FIG. 1 may be prepared as follows. That is, ingredients for an electrically-conductive elastomer layer are kneaded by using a kneader to prepare a material for an electrically-conductive elastomer layer. In addition, the material for an electrically-conductive resin layer is kneaded by using a kneader such as a roll to prepare a mixture, and an organic solvent is added to the mixture. Then, the mixture is mixed and stirred to prepare a coating composition or solution for an electrically-conductive resin layer. Subsequently, the material for an electrically-conductive elastomer layer is filled by injection molding in a mold, wherein the mold includes therein a core rod or pipe (hereafter, referred simply as core rod) that serves as an electrically-conductive support, and thermal cross-linking is performed thereon under a predetermined condition. Afterwards, the resultant is released from the mold to provide a base roll that has an electrically-conductive elastomer layer formed along an outer circumferential surface of the electrically-conductive support. Next, the coating solution for an electrically-conductive resin layer is applied on an outer circumferential surface of the base roll to form an electrically-conductive resin layer. By this, a charging member with the electrically-conductive elastomer layer that is formed on the outer circumferential surface of the electrically-conductive support and the electrically-conductive resin layer that is formed on the outer circumferential surface of the electrically-conductive elastomer layer is produced.

In addition, a formation method of the electrically-conductive elastomer layer is not limited to the injection molding method, and a cast molding method or a method including combination of press molding and polishing may be used. In addition, a coating method of the coating solution for an electrically-conductive resin layer is not particularly limited, and any known method such as dipping, spray-coating, or roll-coating may be used.

<Electrophotographic Imaging Apparatus>

An electrophotographic imaging apparatus according to another aspect of the present disclosure may include an electrophotographic photoconductor, a charging member for charging a circumferential surface of the electrophotographic photoconductor, an exposure means, a developing means, a cleaning means, and a transferring means. Hereafter, the electrophotographic imaging apparatus will be described with reference to FIG. 3.

Figure 3:
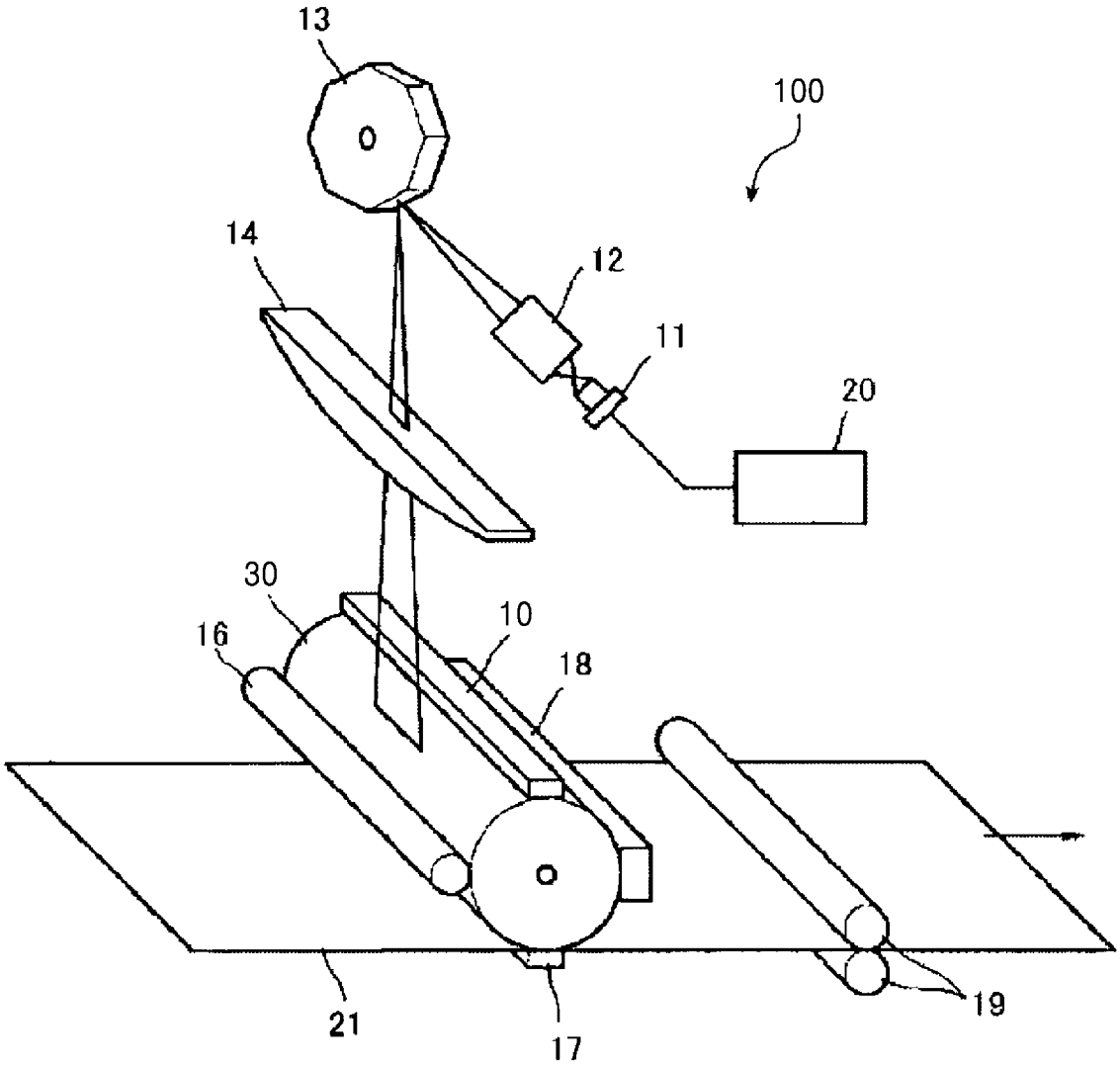
FIG. 3 is a schematic perspective view of an electrophotographic imaging apparatus according to an example.

FIG. 3 is a schematic view of an electrophotographic imaging apparatus 100 according to an example of the present disclosure. The electrophotographic imaging apparatus 100 may include, for example, as an exposure means, a semiconductor laser (an exposure apparatus) 11. A laser beam, which has been undergone signal modulation by a control circuit 20 based on image information, may be parallelized through a correction optical system 12 after emission, and then, reflected by a rotary polygonal mirror 13 to perform scanning motion. Here, the laser beam may be condensed on a surface of an electrophotographic photoconductor 30 by a f-θ lens 14 to perform exposure of image information. The electrophotographic photoconductor 30 may be charged by a charging member 10 in advance, and accordingly, an electrostatic latent image may be formed on a surface thereof by this exposure. Next, by a developing means or device 16, the electrostatic latent image formed on the electrophotographic photoconductor 30 may be developed with a toner to form a toner image to perform visible imagery thereof. Such a visible image may be transferred onto an image carrier 21, such as paper, by using a transferring device 17 which is a transferring means. Then, the image carrier may be fixed with a fixing device 19, which is a fixing means, to be provided as a printed material. The toner or toner components remaining on the surface of the electrophotographic photoconductor 30 may be removed by using a cleaning device 18, which is a cleaning means. Thus, the above process can be repeated.

The electrophotographic photoconductor 30 of FIG. 3 shown in a drum shape may be rotationally driven at a predetermined peripheral speed around the axis. In such a rotation process, the electrophotographic photoconductor 30 may be uniformly charged at a predetermined positive or negative potential on a circumferential surface thereof by using the charging member 10. A voltage applied to the charging member 10 may be, for example, a direct current voltage. However, if necessary, a voltage applied to the charging member 10 may be, for example, a vibration voltage obtained by overlapping an alternating current voltage on a direct current voltage.

In addition, a plurality of components among the electrophotographic photoconductor 30, the charging member 10, the developing means 16, and the like in the electrophotographic imaging apparatus 100 may be integrally combined as a process cartridge, and such a process cartridge may be configured to be easily attached/detached from the main body of the electrophotographic imaging apparatus 100, such as a copying machine or a laser beam printer.

As described above, even if only a direct current voltage is applied to the charging member 10 in the electrophotographic imaging apparatus 100 according to the present example, the charging properties that are stable over a long period of time may be maintained, and high quality of an output image may be also achieved.

EXAMPLES

Hereinafter, the present disclosure will be further described in detail with reference to Examples. However, the present disclosure is for illustrating examples, and thus is not limited to Examples below.

(Preparation of a Material for Forming an Electrically-Conductive Elastomer Layer)

100.00 parts by weight of epichlorohydrin rubber (「Epichlomer CG-102」, available from Daiso Co., Ltd.) as a rubber component; 5.00 parts by weight of sorbitan fatty ester (「Splendor R-300」, available from Kao Chemicals Co., Ltd) as a lubricant; 5.00 parts by weight of ricinoleic acid as a softener; 0.50 parts by weight of a hydrotalcite-based compound (「DHT-4A」 available from Kyowa Chemical Industry Co., Ltd.) as an acid acceptor; 1.00 parts by weight of tetrabutyl ammonium chloride (「Tetrabutyl ammonium chloride」 available from Tokyo Chemical Industry Co., Ltd.) as a conducting agent (an ion conducting agent); 50.00 parts by weight of silica (「Nipsil ER」 available from Tosoh Silica Co., Ltd.) as a filler; 5.00 parts by weight of zinc oxide as a cross-linking accelerator; 1.50 parts by weight of dibenzothiazolyl disulfide; 0.50 parts by weight of tetramethylthiuram monosulfide; and 1.05 parts by weight of sulfur as a cross-linking agent were mixed and kneaded by using a predetermined roll to prepare a material for forming an electrically-conductive elastomer layer (a material for forming a rubber elastic part).

(Preparation of a Coating Solution for Forming an Electrically-Conductive Resin Layer)

100.00 parts by weight of thermoplastic N-methoxymethylated 6-nylon (「Torejin F-30K」 available from Nagase ChemteX Co., Ltd.) which is soluble nylon as a binder resin; 5.00 parts by weight of methylenebisethylmethylaniline (「Curehard-MED」 available from Ihara Chemical Industry Co., Ltd.) as a curing agent; and 18.00 parts by weight of carbon black (「Denka Black HS100」 available from Denki Chemical Industry Co., Ltd.) as a conducting agent (an electronic conductor) were mixed with tetrahydrofuran (THF), and then, resin particles or inorganic particles further described below were added thereto according to the descriptions of Tables 1 and 2 as Examples and Comparative Examples. The mixture was then sufficiently stirred until the solution was homogeneous. Afterwards, each component was dispersed in the solution by using twin rolls, thereby preparing a coating solution for forming an electrically-conductive resin layer. In addition, in Tables 1 and 2, a particle addition amount [phr] refers to an added amount (parts by weight) with respect to 100 parts by weight of the binder resin (e.g., N-methoxymethylated 6-nylone in the present example). In addition, a thickness of an obtained electrically-conductive resin layer was controlled by a concentration of solids in the coating solution.

[Inorganic Particles]

Silica particle (「Sunsphere series」 available from AGS SI Tech Company)

[Resin Particles]

Olefin particles (「Miperon series」 available from Mitsui Chemical Co., Ltd.)

Urethane particles (「Art-pearl series」 available from Negami Chemical Industrial Co., Ltd.)

Here, a particle diameter of each type of particles above was measured as follows. That is, through SEM observation, 100 particles were randomly selected from a group of a plurality of particles, and an average value of the 100 particles was used as an average particle diameter of each type of the particles.

TABLE 1

| | Binder resin | | Particles | | | | |
|---|---|---|---|---|---|---|---|
| | Type | εr1 | Type | εr2 | Oil adsorption [ml/100 g] | Particle diameter [μm] | Addition amount [phr] |
| Example 1 | Soluble nylon | 5.0 | Silica | 4.0 | 30 | 20 | 50 |
| Example 2 | Soluble nylon | 5.0 | Silica | 4.0 | 30 | 20 | 50 |
| Example 3 | Soluble nylon | 5.0 | Silica | 4.0 | 30 | 20 | 40 |
| Example 4 | Soluble nylon | 5.0 | Silica | 4.0 | 30 | 20 | 40 |
| Example 5 | Soluble nylon | 5.0 | Silica | 4.0 | 30 | 20 | 30 |
| Example 6 | Soluble nylon | 5.0 | Silica | 4.0 | 30 | 20 | 30 |
| Example 7 | Soluble nylon | 5.0 | Silica | 4.0 | 30 | 20 | 30 |
| Example 8 | Soluble nylon | 5.0 | Silica | 4.0 | 30 | 20 | 30 |
| Example 9 | Soluble nylon | 5.0 | Silica | 4.0 | 30 | 20 | 20 |
| Example 10 | Soluble nylon | 5.0 | Silica | 4.0 | 30 | 20 | 20 |
| Example 11 | Soluble nylon | 5.0 | Silica | 4.0 | 30 | 20 | 10 |
| Example 12 | Soluble nylon | 5.0 | Silica | 4.0 | 30 | 20 | 10 |
| Example 13 | Soluble nylon | 5.0 | Silica | 2.5 | 150 | 12 | 50 |
| Example 14 | Soluble nylon | 5.0 | Silica | 2.5 | 150 | 12 | 50 |
| Example 15 | Soluble nylon | 5.0 | Silica | 2.5 | 150 | 12 | 40 |
| Example 16 | Soluble nylon | 5.0 | Silica | 2.5 | 150 | 12 | 40 |
| Example 17 | Soluble nylon | 5.0 | Silica | 2.5 | 150 | 12 | 30 |
| Example 18 | Soluble nylon | 5.0 | Silica | 2.5 | 150 | 12 | 30 |
| Example 19 | Soluble nylon | 5.0 | Silica | 2.5 | 150 | 12 | 30 |
| Example 20 | Soluble nylon | 5.0 | Silica | 2.5 | 150 | 12 | 30 |
| Example 21 | Soluble nylon | 5.0 | Silica | 2.5 | 150 | 12 | 20 |
| Example 22 | Soluble nylon | 5.0 | Silica | 2.5 | 150 | 12 | 20 |

TABLE 2

| | Binder resin | | Particles | | | | |
|---|---|---|---|---|---|---|---|
| | Type | εr1 | Type | εr2 | Oil adsorption [ml/100 g] | Particle diameter [μm] | Addition amount [phr] |
| Example 23 | Soluble nylon | 5.0 | Silica | 2.5 | 150 | 12 | 10 |
| Example 24 | Soluble nylon | 5.0 | Silica | 2.5 | 150 | 12 | 10 |
| Example 25 | Soluble nylon | 5.0 | Silica | 1.5 | 300 | 5 | 50 |
| Example 26 | Soluble nylon | 5.0 | Silica | 1.5 | 300 | 5 | 50 |
| Example 27 | Soluble nylon | 5.0 | Silica | 1.5 | 300 | 5 | 40 |
| Example 28 | Soluble nylon | 5.0 | Silica | 1.5 | 300 | 5 | 40 |
| Example 29 | Soluble nylon | 5.0 | Silica | 1.5 | 300 | 5 | 30 |
| Example 30 | Soluble nylon | 5.0 | Silica | 1.5 | 300 | 5 | 30 |
| Example 31 | Soluble nylon | 5.0 | Silica | 1.5 | 300 | 5 | 30 |
| Example 32 | Soluble nylon | 5.0 | Silica | 1.5 | 300 | 5 | 30 |
| Example 33 | Soluble nylon | 5.0 | Silica | 1.5 | 300 | 5 | 20 |
| Example 34 | Soluble nylon | 5.0 | Silica | 1.5 | 300 | 5 | 20 |
| Example 35 | Soluble nylon | 5.0 | Silica | 1.5 | 300 | 5 | 10 |
| Example 36 | Soluble nylon | 5.0 | Silica | 1.5 | 300 | 5 | 10 |
| Example 37 | Soluble nylon | 5.0 | Olefin | 2.2 | — | 10 | 20 |
| Example 38 | Soluble nylon | 5.0 | Olefin | 2.2 | — | 10 | 20 |
| Example 39 | Soluble nylon | 5.0 | Olefin | 2.2 | — | 10 | 30 |
| Example 40 | Soluble nylon | 5.0 | Olefin | 2.2 | — | 10 | 30 |
| CE 1 | Soluble nylon | 5.0 | Urethane | 6.7 | — | 5 | 60 |

TABLE 2-continued

| | Binder resin | | Particles | | | | |
|---|---|---|---|---|---|---|---|
| | Type | εr1 | Type | εr2 | Oil adsorption [ml/100 g] | Particle diameter [μm] | Addition amount [phr] |
| CE 2 | Soluble nylon | 5.0 | Urethane | 6.7 | — | 5 | 60 |
| CE 3 | Soluble nylon | 5.0 | Urethane | 6.7 | — | 25 | 5 |
| CE 4 | Soluble nylon | 5.0 | Urethane | 6.7 | — | 25 | 5 |

* CE: Comparative Example (Preparation of Charging Member)

A roll mold having a roll molding space in the shape of a cylinder was prepared, and a core rod having a diameter of 6 mm was placed in a manner that the core rod was in the same axis with the roll molding space. To the roll molding space with the core rod therein, the material for forming an electrically-conductive elastomer layer prepared as described above was injected. The resultant was heated at 170° C. for 30 minutes, cooled, and released from the mold. Accordingly, an electrically-conductive elastomer layer having a thickness of 3 mm was formed on the outer circumferential surface of the core rod.

Then, the coating solution for forming an electrically-conductive resin layer prepared as described above was applied on a surface of the electrically-conductive elastomer layer in the form of a roll body by using a roll coating method. Here, the coating was performed while dropping an unnecessary coating solution with a scraper so that a coating layer thus formed had a certain thickness. After forming the coating layer, the resultant was heated at 150° C. for 30 minutes, and thus an electrically-conductive resin layer having a thickness of 1.0 μm was formed. Accordingly, a charging member having the electrically-conductive support, the electrically-conductive elastomer layer formed along the outer circumferential surface of the electrically-conductive support, and the electrically-conductive resin layer formed along an outer circumferential surface of the electrically-conductive elastomer layer was prepared.

(Various Evaluation)

The charging members thus obtained were evaluated as follows. The results of the evaluation are shown in Tables 3 and 4.

a) Thickness of the Electrically Conductive Resin Layer and Interparticle Distance A thickness A of the electrically-conductive resin layer was calculated by measuring thicknesses of a plurality of points from an ×5000 magnified image observed by using a scanning electron microscope (SEM). Also, an interparticle distance Sm was measured, with a cut-off of 0.8 mm and a measurement length of 8 mm, by using a method according to JIS B0601-1994 evaluation with a surface roughness tester, SE-3400, available from Kosaka Laboratory Co., Ltd. In particular, randomly selected 6 spots of the charging member were measured by using the tester, and an average value of the 6 spots was used as a measured value for the corresponding sample.

b) 10-Point Average Roughness of the Electrically-Conductive Resin Layer

A 10-point average roughness (RzJIS) of the electrically-conductive resin layer was measured at a cut-off of 0.8 mm, a measurement rate of 0.5 mm/s, and a measurement length of 8 mm by using a method according to 10-point average roughness evaluation of JIS B0601-1994 with a surface roughness tester, SE-3400, available from Kosaka Laboratory Co., Ltd. In particular, randomly selected 6 spots of the charging member were measured by using the tester, and an average value of the 6 spots was used as a 10-point average roughness.

c) Image Formation Evaluation

For use as an imaging apparatus, MultixpressC8640ND available from Samsung Electronics was used. The charging member obtained as described above was installed thereto, and image formation evaluation was performed according to the following conditions.

<Image Formation Condition>

Printing environment: Under room temperature, room humidity environments (23° C./60% RH)

Printing condition: A normal printing speed of 305 mm/sec, a half-speed thereof, the number of printing sheets (360 kPV), and a type of paper (OfficePaperEC)

Load toward an end of conductive support: One-side 5.88 N

Applied bias: it was appropriately determined for a photoconductor surface potential to be −600 V.

c-1) Charging Uniformity Evaluation

A half-tone image was printed out by using the imaging apparatus at a normal speed of (1/1) and a half-speed thereof (½) at the beginning of and after running 360 kPV. Charging defect (microjitter) appeared on the image was observed with the naked eyes, and was evaluated according to the following standards:

Evaluation A: Uniform or even half-tone image was obtained.

Evaluation B: Slight uneven charging occurred on the periphery of the image.

Evaluation C: Significant uneven charging occurred on the periphery of the image.

Evaluation D: Uneven charging occurred on the whole image.

c-2) Image Quality Evaluation

Image quality was evaluated by using an image processing apparatus, PIAS-II (Personal Image Analysis System LA-555 available from PIAS Company). In detail, a printed pattern formed of 2×2 dots by using the imaging apparatus was introduced as image data in PIAS-II, wherein the values of the quantified or digitized image concentration, the graininess, and the mottle were each read. In the present Example, in consideration of a correlation between the image concentration and the mottle, the image quality was evaluated using a value of the mottle at the concentration of 0.2.

TABLE 3

| | Electrically-conductive resin layer | | | Uniform charging | | | | |
|---|---|---|---|---|---|---|---|---|
| | | | | Initial | | After running 360 kPV | | |
| | Thickness [μm] | Rz [μm] | Sm [μm] | Speed of 1/1 | Speed of 1/2 | Speed of 1/1 | Speed of 1/2 | Image quality (Mottle) |
| Example 1 | 0.5 | 25.0 | 50.0 | A | A | A | A | 1.6 |
| Example 2 | 5.0 | 20.0 | 50.0 | A | A | A | A | 1.6 |
| Example 3 | 1.0 | 24.0 | 100.0 | A | A | A | A | 1.5 |

TABLE 3-continued

| | Electrically-conductive resin layer | | | Uniform charging | | | | |
|---|---|---|---|---|---|---|---|---|
| | | | | Initial | | After running 360 kPV | | |
| | Thickness [μm] | Rz [μm] | Sm [μm] | Speed of 1/1 | Speed of 1/2 | Speed of 1/1 | Speed of 1/2 | Image quality (Mottle) |
| Example 4 | 4.0 | 21.0 | 100.0 | A | A | A | A | 1.5 |
| Example 5 | 3.0 | 21.0 | 130.0 | A | A | A | A | 1.5 |
| Example 6 | 3.0 | 22.0 | 130.0 | A | A | A | A | 1.5 |
| Example 7 | 3.0 | 21.0 | 180.0 | A | A | A | A | 1.5 |
| Example 8 | 3.0 | 22.0 | 180.0 | A | A | A | A | 1.5 |
| Example 9 | 1.0 | 24.0 | 200.0 | A | A | A | A | 1.5 |
| Example 10 | 4.0 | 21.0 | 200.0 | A | A | A | A | 1.5 |
| Example 11 | 0.5 | 24.0 | 250.0 | A | A | A | A | 1.6 |
| Example 12 | 5.0 | 20.0 | 250.0 | A | A | A | A | 1.6 |
| Example 13 | 0.5 | 16.0 | 50.0 | A | A | A | A | 1.5 |
| Example 14 | 5.0 | 12.0 | 50.0 | A | A | B | B | 1.5 |
| Example 15 | 1.0 | 17.0 | 100.0 | A | A | A | A | 1.4 |
| Example 16 | 4.0 | 14.0 | 100.0 | A | A | B | B | 1.4 |
| Example 17 | 3.0 | 15.0 | 130.0 | A | A | A | A | 1.3 |
| Example 18 | 3.0 | 16.0 | 130.0 | A | A | A | A | 1.3 |
| Example 19 | 3.0 | 15.0 | 180.0 | A | A | A | A | 1.3 |
| Example 20 | 3.0 | 16.0 | 180.0 | A | A | A | A | 1.3 |
| Example 21 | 1.0 | 17.0 | 200.0 | A | A | A | A | 1.4 |
| Example 22 | 4.0 | 13.0 | 200.0 | A | A | B | B | 1.4 |

TABLE 4

| | Electrically-conductive resin layer | | | Uniform charging | | | | |
|---|---|---|---|---|---|---|---|---|
| | | | | Initial | | After running 360 kPV | | |
| | Thickness [μm] | Rz [μm] | Sm [μm] | Speed of 1/1 | Speed of 1/2 | Speed of 1/1 | Speed of 1/2 | Image quality (Mottle) |
| Example 23 | 0.5 | 17.0 | 250.0 | A | A | A | A | 1.5 |
| Example 24 | 5.0 | 13.0 | 250.0 | A | A | B | B | 1.5 |
| Example 25 | 0.5 | 5.0 | 50.0 | A | B | B | C | 1.4 |
| Example 26 | 5.0 | 7.0 | 50.0 | A | B | B | C | 1.4 |
| Example 27 | 1.0 | 10.0 | 100.0 | A | B | B | B | 1.3 |
| Example 28 | 4.0 | 7.0 | 100.0 | A | B | B | C | 1.3 |
| Example 29 | 3.0 | 8.0 | 130.0 | A | B | B | B | 1.2 |
| Example 30 | 3.0 | 9.0 | 130.0 | A | B | B | B | 1.2 |

TABLE 4-continued

| | Electrically-conductive resin layer | | | Uniform charging | | | | |
|---|---|---|---|---|---|---|---|---|
| | | | | Initial | | After running 360 kPV | | Image |
| | Thickness [μm] | Rz [μm] | Sm [μm] | Speed of 1/1 | Speed of 1/2 | Speed of 1/1 | Speed of 1/2 | quality (Mottle) |
| Example 31 | 3.0 | 8.0 | 180.0 | A | B | B | B | 1.2 |
| Example 32 | 3.0 | 9.0 | 180.0 | A | B | B | B | 1.2 |
| Example 33 | 1.0 | 10.0 | 200.0 | A | B | B | B | 1.3 |
| Example 34 | 4.0 | 7.0 | 200.0 | A | B | B | C | 1.3 |
| Example 35 | 0.5 | 7.0 | 250.0 | A | B | B | C | 1.4 |
| Example 36 | 5.0 | 7.0 | 250.0 | A | B | B | C | 1.4 |
| Example 37 | 3.0 | 12.0 | 130.0 | A | A | B | B | 1.3 |
| Example 38 | 3.0 | 15.0 | 130.0 | A | A | A | A | 1.3 |
| Example 39 | 3.0 | 12.0 | 180.0 | A | A | B | B | 1.3 |
| Example 40 | 3.0 | 15.0 | 180.0 | A | A | A | A | 1.3 |
| CE* 1 | 0.5 | 5.0 | 20.0 | D | D | D | D | 1.8 |
| CE 2 | 5.0 | 7.0 | 20.0 | D | D | D | D | 1.8 |
| CE 3 | 0.5 | 30 | 300 | A | A | A | A | 1.8 |
| CE 4 | 5.0 | 28 | 300 | A | A | A | A | 1.8 |

*CE: Comparative Example

When the imaging apparatus including the charging member of each of Examples was used, stable charging properties may be maintained over a long period of time even when only a direct current voltage is applied, and high quality of an output image may be achieved.

It should be understood that examples described herein should be considered in a descriptive sense and not for purposes of limitation. Descriptions of features or aspects within an example should generally be considered as available for other similar features or aspects in other examples.

While examples have been described with reference to the figures, it will be understood by those of ordinary skill in the art that various changes in form and details may be made therein without departing from the spirit and scope of the disclosure as defined by the following claims.

The invention claimed is:

1. A charging member coupleable to an electrophotographic imaging apparatus, the charging member comprising:

an electrically-conductive support body;

an electrically-conductive elastomer layer stacked on a surface of the electrically-conductive support body; and an electrically-conductive resin layer stacked as an outermost layer on the electrically-conductive elastomer layer, the electrically-conductive resin layer including a binder resin, and particles comprising a type of particles selected from resin particles and inorganic particles, wherein a relative dielectric constant (εr1) of the binder resin is greater than or about equal to a relative dielectric constant (εr2) of the type of particles.

2. The charging member of claim 1, wherein εr2 is in a range of about 1.5 to about 4.0.

3. The charging member of claim 1, wherein a thickness of the electrically-conductive resin layer is in a range of about 0.5 μm to about 5.0 μm.

4. The charging member of claim 1, wherein a 10-point average roughness (RzJIS) of the electrically-conductive resin layer is in a range of about 5.0 μm to about 25.0 μm, and an interparticle distance (Sm) of the particles is in a range of about 50 μm to about 250 μm.

5. The charging member of claim 1, wherein an average particle diameter of the particles is in a range of about 5.0 μm to about 25.0 μm.

6. The charging member of claim 1, wherein an amount of the particles included in the electrically-conductive resin layer is in a range of about 10 parts to about 50 parts by weight per 100 parts by weight of the binder resin.

7. The charging member of claim 1, wherein the resin particles are olefin-based resin particles, and the inorganic particles are silica particles.

8. The charging member of claim 1, wherein the inorganic particles have a porous structure.

9. The charging member of claim 1, wherein an oil adsorption amount of the inorganic particles is in a range of about 30 ml/100 g to about 300 ml/100 g.

10. The charging member of claim 1, wherein the resin particles include ultra-high-molecular-weight polyethylene.

11. An electrophotographic imaging apparatus comprising:

an electrophotographic photoconductor;

a charging member to charge the electrophotographic photoconductor, the charging member including:

an electrically-conductive support body;

an electrically-conductive elastomer layer stacked on a surface of the electrically-conductive support body; and an electrically-conductive resin layer stacked as an outermost layer on the electrically-conductive elastomer layer, the electrically-conductive resin layer includes a binder resin, and particles comprising a type of particles selected from resin particles and inorganic particles, wherein a relative dielectric constant (εr1) of the binder resin is greater than or about equal to a relative dielectric constant (εr2) of the type of particles.

12. The electrophotographic imaging apparatus of claim 11, wherein εr2 is about 1.5 to about 4.0.

13. The electrophotographic imaging apparatus of claim 11, wherein a thickness of the electrically-conductive resin layer is in a range of about 0.5 μm to about 5.0 μm.

14. The electrophotographic imaging apparatus of claim 11, wherein a 10-point average roughness (RzJIS) of the electrically-conductive resin layer is a range of about 5.0 μm to about 25.0 μm, and an interparticle distance (Sm) of the particles is in a range of about 50 μm to about 250 μm.

15. The electrophotographic imaging apparatus of claim 11, wherein an average particle diameter of the particles is in a range of about 5.0 μm to about 25.0 μm;

an amount of the particles included in the electrically-conductive resin layer is in a range of about 10 parts to about 50 parts by weight per 100 parts by weight of the binder resin;

the resin particles are olefin-based resin particles, and the inorganic particles are silica particles;

the inorganic particles have a porous structure;

an oil adsorption amount of the inorganic particles is in a range of about 30 ml/100 g to about 300 ml/100 g; and/or a direct current voltage is applied to the charging member.

* * * * *